United States Patent [19]

Dyck et al.

[11] Patent Number: 4,532,428

[45] Date of Patent: Jul. 30, 1985

[54] CONCRETE SHIELDING HOUSING FOR RECEIVING AND STORING A NUCLEAR FUEL ELEMENT CONTAINER

[75] Inventors: Hans-Peter Dyck, Burgdorf; Harry Spilker, Bad Muender; Heinz-Dieter Gregor, Hanover, all of Fed. Rep. of Germany

[73] Assignee: Deutsche Gesellschaft für Wiederaufarbeitung von Kernbrennstoffen mbH, Hanover, Fed. Rep. of Germany

[21] Appl. No.: 437,750

[22] Filed: Oct. 29, 1982

[30] Foreign Application Priority Data

Nov. 5, 1981 [DE] Fed. Rep. of Germany ..... 3143865

[51] Int. Cl.[3] ..... G21F 5/00

[52] U.S. Cl. ..... 250/507.1; 250/506.1; 252/633

[58] Field of Search ..... 250/506.1, 507.1; 252/626, 633

[56] References Cited

FOREIGN PATENT DOCUMENTS 2091477A 7/1982 United Kingdom ..... 252/633

OTHER PUBLICATIONS

Nelson et al., "Retrievable Surface Storage Facility . . . ", *Nuclear Technology*, vol. 24, Dec. 1974, pp. 391–397.

*Primary Examiner*—Alfred E. Smith
*Assistant Examiner*—Jack I. Berman
*Attorney, Agent, or Firm*—Walter Ottesen

[57] ABSTRACT

The invention is directed to a concrete shielding housing for receiving and storing a transportable fuel element container which is suitable for storage and filled with spent nuclear reactor fuel elements. The clear interior dimensions of the concrete shielding housing are somewhat larger than the outer dimensions of the container. During its temporary storage the fuel element container must be monitored with suitable measuring instruments. In order to make the monitoring as simple as possible, measuring probes are arranged on the inner wall surface of the shielding wall of the concrete shielding housing. The measuring probes are embedded in the concrete and are already in place and ready for use before the fuel element container is loaded into the concrete shielding housing.

4 Claims, 1 Drawing Figure

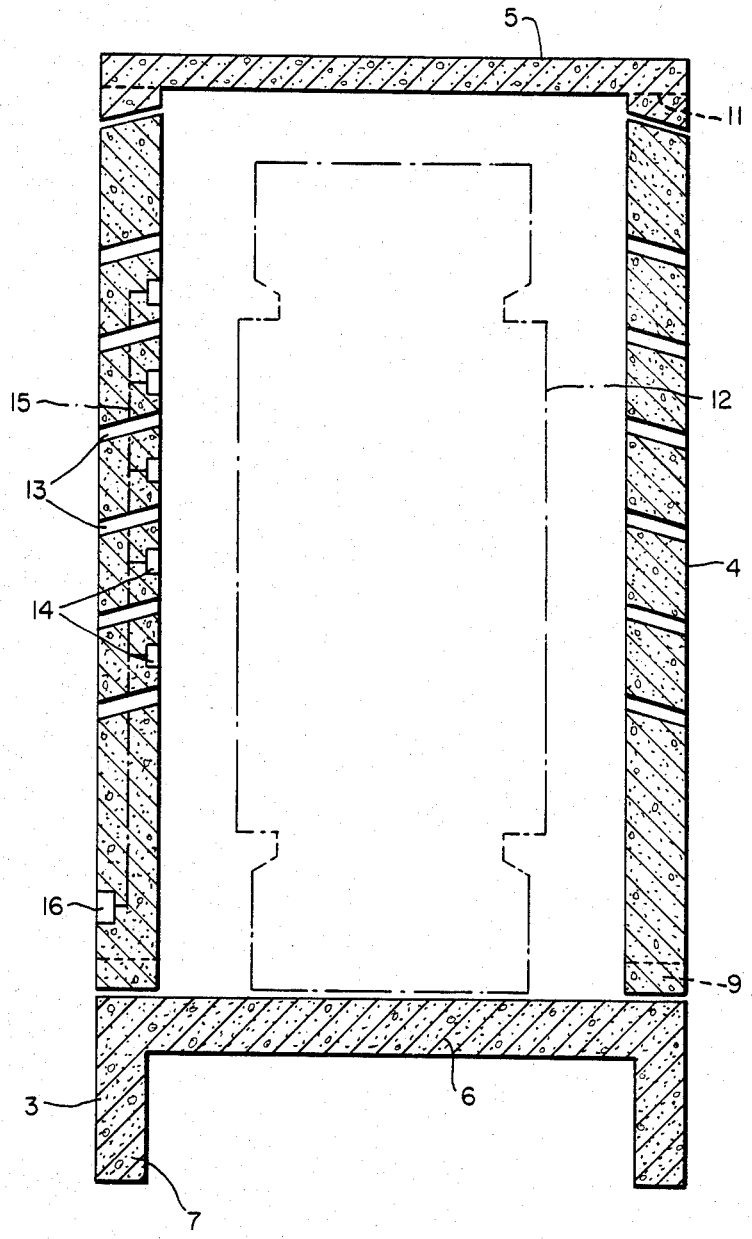
5
11
15
12
13
4
14
16
9
3
6
7

CONCRETE SHIELDING HOUSING FOR RECEIVING AND STORING A NUCLEAR FUEL ELEMENT CONTAINER

FIELD OF THE INVENTION

The invention relates to a concrete shielding housing for receiving and storing a fuel element container filled with spent nuclear reactor fuel elements. The container is suitable for transport and storage. The clear interior dimensions of the concrete shielding housing are somewhat larger than the outer dimensions of the fuel element container.

BACKGROUND OF THE INVENTION

In efforts to provide a temporary storage for fuel element containers in the open, it has been suggested to accommodate the containers in silo-like housings made of concrete or steel-reinforced concrete. These silo-like housings can be of different configurations and are each suitable for accommodating one fuel element container. In one such configuration of a shielding housing for receiving fuel element containers, the shielding housing is provided with lateral air inlet passages at the lower end of the shielding wall and lateral air outlet passages in the region of the upper end of the shielding wall beneath the cover. With this arrangement of air inlet and air outlet openings, a natural ventilation within the housing is obtained for directing away heat produced by the radioactive decay of materials stored in the container.

It is a well-known technique to monitor the fuel element container during its temporary storage by means of appropriate measuring instruments. In this way, for example, the temperature of the fuel element container is continuously monitored.

SUMMARY OF THE INVENTION

It is an object of the invention to conveniently monitor a fuel element container disposed in a concrete shielding housing where it has been placed for temporary storage. It is another object of the invention to configure such a concrete shielding housing to enable the container to be monitored during its temporary storage therein.

The concrete shielding housing according to the invention includes a base and a concrete shielding wall mounted on the base. The shielding wall and base conjointly define an enclosed space having clear interior dimensions somewhat larger than the outer dimensions of the container. It is a feature of the invention to provide a plurality of measuring probes embedded in the concrete of the wall at the region of the inner wall surface thereof.

The measuring probes for monitoring the fuel element container are therefore already available before the concrete shielding housing is loaded with the fuel element container. In this way, the inconvenience and cost of arranging the measuring probes after the housing has been filled with a fuel element container is avoided. The measuring probes and their electric connecting leads can be embedded into the concrete housing wall when the latter is cast.

According to another feature of the invention, radial ventilating passages can be formed in the concrete shielding wall and a plurality of measuring probes in the form of temperature detectors can be arranged at respectively different elevations in the shielding wall. The ventilating passages are formed in the shielding wall so as to be inclined to the horizontal.

The radial ventilating passages increase the natural convection while at the same time minimize the amount of radiation emanating from the housing. The temperature detectors arranged at respectively different elevations can detect a possibly different temperature profile caused by the radial air passages.

BRIEF DESCRIPTION OF THE DRAWING

The drawing shows an elevation view, in section, of the concrete shielding housing of the invention. The drawing also depicts a fuel element container in phantom outline disposed therein.

DESCRIPTION OF THE PREFERRED EMBODIMENTS OF THE INVENTION

The concrete shielding housing includes a pallet-like base 3 upon which is placed a cylindrical concrete shielding wall 4. A cover 5 forms part of the housing and lies upon the concrete shielding wall 4.

The base 3 includes a square base plate having feet 7 mounted at respective corners of the base plate 6 so that the base 3 is configured as a pallet accessible from beneath for moving the same from one location to another. The cylindrically-formed concrete shielding wall 4 is placed upon the base 3 and is aligned by means of a suitable centering arrangement (not shown).

The concrete shielding wall 4 has openings 9 at its lower end which serve as air inlet passages. The cover 5 lying upon the concrete shielding wall 4 is likewise provided with openings 11 at its periphery which serve as air outlet passages. The openings 11 are located at the surface of the cover engaging the wall 4. The fuel element container 12 is shown in phantom outline and is standing on the base plate 6 of the base 3.

The housing wall 4 is provided with a plurality of air openings 13 which extend clear through the wall and are inclined to the horizontal as shown. Temperature detectors are cast into the housing wall at the inner surface thereof and are located at respectively different elevations. These temperature sensors are connected via corresponding electrical leads 15 with a connector 16 disposed at the outside surface of the housing wall 4.

When the fuel element container 12 is delivered to the temporary storage facility, it is placed upon the base plate 6 of the base 3. Thereafter, the concrete shielding wall 4 is placed over the container 12 so that it too rests upon the base 3. Finally, the cover 5 is placed on the upper free end of the concrete shielding wall 4.

The entire concrete shielding housing made up of parts 3, 4, and 5 can now be brought to the storage area by means of a suitable vehicle such as a fork-lift truck. The storage area is preferably in the open air. After the concrete shielding housing is positioned at the storage location, the temperature detectors 14 for monitoring the temperature in the interior of the housing can be connected to an overall monitoring system. This connection is achieved by a simple plug-type connection at the outside surface of the housing wall 4.

The temperature detectors as well as their corresponding electrical connecting means 15 can be positioned in the form in which the concrete shielding wall 4 is cast so that they are completely enclosed by the binding mold mass.

Other modifications and variations to the embodiments described will now be apparent to those skilled in the art. Accordingly, the aforesaid embodiments are not to be construed as limiting the breadth of the invention. The full scope and extent of the present contribution can only be appreciated in view of the appended claims.

What is claimed is:

1. A concrete shielding housing for receiving and storing a transportable fuel element container which is suitable for storage and filled with spent nuclear reactor fuel elements, the housing comprising:

a base;

a concrete shielding wall disposed on said base; and, a cover atop the shielding wall;

said shielding wall, said cover and said base conjointly defining an enclosed space having interior dimensions somewhat larger than the outer dimensions of the container, and a plurality of detectors embedded in the concrete of said wall for detecting a physical quantity radiated from the container, said detectors being arranged in said wall spaced one from the other so as to permit a profile of said quantity to be detected.

2. A concrete shielding housing for receiving and storing a transportable fuel element container which is suitable for storage and filled with spent nuclear reactor fuel elements, the housing comprising:

a base;

a concrete shielding wall disposed on said base; and, a cover atop the shielding wall;

said shielding wall, said cover and said base conjointly defining an enclosed space having interior dimensions somewhat larger than the outer dimensions of the container; and measuring probe means embedded in the concrete of said wall at the region of the inner wall surface thereof for monitoring the container;

said concrete shielding wall having radial ventilating passages formed therein, said measuring probe means being a plurality of temperature detectors arranged at respectively different elevations in said shielding wall.

3. The concrete shielding housing of claim 2, said ventilating passages being formed in said shielding wall so as to be inclined to the horizontal.

4. A concrete shielding housing for receiving and storing a transportable fuel element container which is suitable for storage and filled with spent nuclear reactor fuel elements, the housing comprising:

a base;

a concrete shielding wall disposed on said base; and, a cover atop the shielding wall;

said shielding wall, said cover and said base conjointly defining an enclosed space having interior dimensions somewhat larger than the outer dimensions of the container;

measuring probe means embedded in the concrete of said wall at the region of the inner wall surface thereof for monitoring the container;

said measuring probe means being a plurality of temperature detectors arranged at respectively different elevations in said shielding wall;

an electrical connector mounted with respect to the outside surface of said shielding wall so as to be accessible from the exterior thereof and, connecting lead means embedded in said wall for electrically connecting said connector with said temperature detectors.

* * * * *